US008602171B2

(12) United States Patent
Vogl

(10) Patent No.: US 8,602,171 B2
(45) Date of Patent: Dec. 10, 2013

(54) METHOD OF CONTROLLING ACCESS TO AN ELEVATOR CAR

(75) Inventor: Wolfgang Vogl, Küssnacht a/Rigi (CH)

(73) Assignee: Inventio AG, Hergiswil (CH)

( * ) Notice: Subject to any disclaimer, the term of this patent is extended or adjusted under 35 U.S.C. 154(b) by 614 days.

(21) Appl. No.: 11/881,212

(22) Filed: Jul. 26, 2007

(65) Prior Publication Data

US 2008/0047783 A1 Feb. 28, 2008

(30) Foreign Application Priority Data

Jul. 26, 2006 (EP) ..... 06117891

(51) Int. Cl.

| | |
|---|---|
| ***B66B 1/16*** | (2006.01) |
| ***B66B 13/14*** | (2006.01) |
| ***B66B 1/06*** | (2006.01) |
| ***B66B 1/36*** | (2006.01) |

(52) U.S. Cl.

USPC ..... 187/380; 187/298; 187/314; 187/389

(58) Field of Classification Search

USPC ..... 187/295, 298, 316, 380, 381, 383, 387, 187/314, 389

IPC ..... B66B 1/06,1/16, 1/36, 1/52, 5/02, 11/00, B66B 13/14

See application file for complete search history.

(56) References Cited

U.S. PATENT DOCUMENTS

| | | | | | |
|---|---|---|---|---|---|
| 4,157,133 | A * | 6/1979 | Corcoran et al. | ..... | 187/384 |
| 4,352,410 | A * | 10/1982 | Bittar et al. | ..... | 187/381 |
| 5,679,934 | A * | 10/1997 | Juntunen et al. | ..... | 187/395 |
| 5,740,888 | A * | 4/1998 | Aulanko et al. | ..... | 187/336 |
| 5,773,771 | A * | 6/1998 | Chatham | ..... | 187/282 |
| 6,202,801 | B1 * | 3/2001 | Muller et al. | ..... | 187/401 |
| 6,630,886 | B2 * | 10/2003 | Malone, Jr. | ..... | 340/540 |
| 6,736,242 | B2 * | 5/2004 | Nygren | ..... | 187/357 |
| 6,880,678 | B1 * | 4/2005 | Schneider et al. | ..... | 187/314 |
| 7,077,243 | B2 * | 7/2006 | Huber et al. | ..... | 187/357 |
| 7,114,594 | B2 * | 10/2006 | Rossignol et al. | ..... | 187/336 |
| 7,258,202 | B1 * | 8/2007 | Rossignol | ..... | 187/351 |
| 2006/0108181 | A1 * | 5/2006 | Bacellar et al. | ..... | 187/247 |
| 2011/0048866 | A1 * | 3/2011 | Tokura | ..... | 187/387 |
| 2011/0132699 | A1 * | 6/2011 | Tokura et al. | ..... | 187/382 |

FOREIGN PATENT DOCUMENTS

| | | | |
|---|---|---|---|
| EP | 1174381 | A1 * | 1/2002 |
| EP | 1466853 | | 10/2004 |
| EP | 1950165 | A1 * | 7/2008 |
| JP | 2225278 | | 9/1990 |
| JP | 11139697 | A * | 5/1999 |
| JP | 2002114462 | A * | 4/2002 |
| WO | WO2005/026033 | | 3/2005 |
| WO | WO2005/095249 | | 10/2005 |

* cited by examiner

*Primary Examiner* — William A Rivera
*Assistant Examiner* — Stefan Kruer
(74) *Attorney, Agent, or Firm* — Wolff & Samson, PC

(57) ABSTRACT

A method of controlling access to an elevator car, in particular to its roof and/or underside, including the steps of switching the elevator control into a maintenance mode which controls the car to travel to a predetermined stop position permitting access, and opening a landing door of the elevator shaft the car is running in. The elevator control is switched into the maintenance mode only if operating a landing call receiving device in a predetermined identification pattern which differs from a call pattern for calling the elevator.

11 Claims, 1 Drawing Sheet

METHOD OF CONTROLLING ACCESS TO AN ELEVATOR CAR

BACKGROUND OF THE INVENTION

The present invention relates to a method of controlling access to an elevator car, in particular for maintenance and/or inspection.

In order to perform inspection and/or maintenance to an elevator (which will be called maintenance collectively in the following without loss of generality) it is necessary to get access to the single cars of the elevator, in particular to their roof and/or underside.

Conventionally, the maintenance mechanic thereto calls the car to his floor and stops the car by opening the elevator shaft door with a triangular key when the roof of the car is on a level which is accessible from said floor. Vice versa he may stop the car by opening the elevator shaft door when the bottom of the car is on a level which makes it possible to visually inspect the components arranged in the region of the car bottom or to get access to the underside of the car. With respect to FIG. 1 for example the maintenance mechanic 6 may call the elevator car by operating the landing call button on level E4. The moment at which car 5, arriving in response to the call, is halfway between level E3 and subsequent level E4, the mechanic opens the landing door T4 manually with a triangular key. An opened door automatically stops the traveling car so that mechanic 6 gets access to the car roof 7 from door T4. Having finished maintenance, mechanic 6 leaves the car roof and the elevator shaft 1 and closes the door T4, so that the elevator may resume its normal routine. On the other hand, as shown in FIG. 2, the mechanic 6 may call the elevator car to the lowest level E1. By opening door T1 of level E1, he stops the car on a level between E2 and E1 in order to be able to enter into the shaft pit and to get access to the car underside from the bottom of the shaft pit. Having finished maintenance, mechanic 6 leaves the shaft pit 2 and closes the door T1, so that the elevator may resume its normal routine.

However, this conventional method—although quite simple—has some disadvantages. If there is a group of parallel elevators, the maintenance mechanic cannot selectively call the car to be maintained but the elevator group control will send one car out of the group in response to his call according to a predetermined routine (e.g. based on registered calls, distances between cars and calling floor etc.). Thus, the mechanic cannot select a specific car in order to perform maintenance work on a specific elevator of the elevator group.

Furthermore, it is quite difficult to stop the car at the desired position between two floor levels by opening the door manually, in particular when correct coincidence between the car roof or underside and the landing door is required (if, for example, heavy machinery is to be transferred onto the car roof or the like). Thereto, the mechanic must take into account inertia of the car, stopping distance etc.

Yet furthermore, also unauthorized people can adopt the conventional method, i.e., a simple triangular key allows access to the car roof and has been misused frequently for so-called elevator-surfing.

In view of these problems, JP 02 225278 A suggests a cipher signal output means providing cipher signals causing a control to move the elevator car to a stop position of a car so that its roof level coincides with a selected boarding hall level. After opening the landing door, a mechanic then has access to the car roof.

However, this method requires registration of the cipher signal by the control and thus specific means for inputting and for receiving this signal. Moreover, the cipher signal also must indicate the car to be maintained as well as the floor the mechanic wants to get access from. This method implies additional hardware requirements as well as complex signals in order to overcome the problems described above. Therefore this method is complex and expensive.

SUMMARY OF THE INVENTION

It is an objective of the present invention to provide a method of controlling access to an elevator car, in particular to its roof and/or underside, in a simple way.

According to one aspect of the present invention, a method of controlling access to an elevator car, in particular to its roof and/or underside, comprises the steps of:

switching the elevator control into a maintenance mode which controls the car to travel to a predetermined stop position in which access is permitted from a landing door, in particular to its roof and/or underside; and opening the landing door of the elevator shaft the car is running in.

Therein, the elevator control is switched into the maintenance mode by at least operating a landing call receiving means in a predetermined identification pattern which is different from the normal pattern to call the elevator. In other words, operating a landing call receiving means in the predetermined identification pattern is a necessary condition to switch into maintenance mode. Operating a landing call receiving means in the predetermined identification pattern alone may already be sufficient to switch into maintenance mode. Alternatively, switching into maintenance mode may require the fulfillment of additional conditions, like opening a landing door.

Using the landing call receiving means to switch into maintenance mode by operating it in a predetermined identification pattern, there is no need for additional extra means for sending and receiving the required signals. Instead, hardware may be used which is anyway included in conventional elevators. Only the related control functions are to be adapted. Additionally, the floor from which the maintenance mechanic wants to get access to the car is automatically recognized by identifying the corresponding landing call receiving means.

Moreover, elevator surfing effectively is prevented since one must know the predetermined identification pattern to command the elevator control to move the car to a predetermined stop position which allows access from a landing door to the roof of the car. By keeping said predetermined identification pattern secret, access to the car roof by unauthorized people is excluded.

In particular, the landing call receiving means may comprise a call button, a card reader and/or a voice call means. If the landing call receiving means comprises a call button, the predetermined identification pattern may be characterized by a predetermined sequence of pressing the button. In one embodiment, this sequence may be defined as a certain number of presses within a predetermined time period, e.g. three presses within three seconds or the like. In another embodiment, this sequence may be defined like a Morse signal, e.g. by two short presses followed by one long press and another four short presses (providing "INS" in morse code as an abbreviation of the word "INSPECTION"). In another embodiment the sequence may comprise pressing an "up" and "down" button in a predetermined pattern. Thereby, an identification pattern can be distinguished from a normal call pattern like one press or repeated presses in a random sequence, e.g. from presses entered, for example, by different passengers or one impatient passenger.

If, for example, the landing call receiving means comprises a card reader, there can be provided a special maintenance card comprising a predetermined identification pattern, or a predetermined identification pattern may be defined by inserting a normal card different times in a predetermined sequence and/or direction (e.g. inserting the card twice in a first direction, followed by inserting it once in an opposite direction).

If, for example, the landing call receiving means comprises a voice call means, the maintenance mechanic may speak a code word or the like as the predetermined identification pattern.

In a preferred embodiment of the present invention, the landing door must also be unlocked or opened for a short time to switch into said maintenance mode. Thus, it requires hardware equipment to open the landing door and cryptic knowledge of the identification pattern to call a car to a stop position permitting access.

Moreover, by opening the landing door of a specific elevator shaft, one out of a group of elevator cars can be selected in a simple manner. Alternatively, the car also may be selected by operating the landing call receiving means in different car-specific predetermined identification patterns, i.e. different predetermined patterns identifying different cars.

Advantageously, the landing door must be unlocked or opened within a predetermined time period before or after operating the landing call receiving means to switch into said maintenance mode. Thus, only if an authorized mechanic opens a landing door and inputs the identification pattern within said specific time period, the pattern will be recognized as identification pattern. If, on the contrary, the landing call receiving means is operated in the predetermined pattern by chance, this will not be accepted as an identification pattern since the landing door is not unlocked or opened at the same occasion.

According to one embodiment of the present invention the elevator control is switched into said maintenance mode by, firstly, unlocking or opening the landing door and, subsequently, operating the landing call receiving means in the predetermined identification pattern. The elevator control is switched into a blocked status inhibiting travel of the corresponding car by said unlocking or opening of a landing door. If, and only if, subsequently the landing call receiving means is operated in the predetermined identification pattern, the elevator control then is switched from blocked status into maintenance mode for the car corresponding to the unlocked or opened landing door, allowing to move the car to a predetermined stop position.

According to another embodiment of the present invention the elevator control is switched into said maintenance mode vice versa by, firstly, operating the landing call receiving means in the predetermined identification pattern, and, subsequently, opening or unlocking the landing door. Thus, the elevator control is switched into a pre-maintenance mode by operating the landing call receiving means in the predetermined identification pattern and will not switch into a blocked status when a landing door is unlocked or opened afterwards, but will then switch into maintenance mode. In all other cases, i.e. when the elevator control is not switched into pre-maintenance mode, it will switch into blocked status when a landing door is opened, thus also preventing misuse in form of elevator surfing as well as other dangerous situations caused by unintended opening of a landing door.

The landing door may be opened manually by actuating an emergency unlocking system, preferably by means of a triangular key. Conventional triangular keys may be used for an emergency unlocking system while at the same time misuse is prevented since a predetermined identification code is additionally necessary to switch into maintenance mode, i.e. to allow access to the roof or the underside of a car. If only a landing door is opened without operating the landing call receiving means in the predetermined identification pattern, the elevator control may automatically switch into a blocked status, preventing travel of the car.

Preferably, the maintenance stop position may be determined by the floor of the operated landing call receiving means, i.e. by the level at which said means is situated. In an advantageous embodiment of the present invention, access to the car underside only is possible from a shaft pit at the bottom of the elevator shaft, i.e. when the car is in a position where its underside is placed a certain distance above the lowest floor level, allowing access of the maintenance mechanic from the lowest landing door to the shaft pit. Vice versa, access to the car roof is possible only from levels beyond the lowest level since the car cannot descend so that its roof coincides with the lowest level. Thus, operating a landing call receiving means positioned at the lowest level will indicate maintenance of the car underside, and the elevator control will control the car into a position allowing access to its underside from within the shaft pit. On the other side, operating a landing call receiving means positioned at another landing level will indicate maintenance of or from the car roof, and the elevator control will move the car into a position allowing access to its roof from the floor level of the landing call receiving means (e.g. car roof level approximately coinciding with the landing floor level).

According to another aspect of the present invention also the predetermined identification pattern itself may indicate a maintenance stop position, in particular a stop position allowing access to or at least sight of the roof or the underside of the car, with respect to the floor of the landing call receiving means. In a preferred embodiment, a first predetermined identification pattern indicates a stop position allowing access to the roof while a second predetermined identification pattern, different from the first, indicates a stop position allowing access to or sight of the underside of the car, from the floor of the landing call receiving means.

For example, pressing a call button three times within five seconds may switch the elevator control in a roof maintenance mode in which the car is controlled to travel into a stop position in which its roof substantially coincides with the landing floor level of the floor in which the operated landing call receiving means is located. Having opened the corresponding landing door before or after operating the call button accordingly, the maintenance mechanic then easily has access the roof of the selected car. On the other hand, pressing the call button twice within five seconds may switch the elevator control in a underside maintenance mode in which the car is controlled to travel into a stop position above the landing floor level of the floor in which the operated landing call receiving means is located. Having unlocked or opened the corresponding landing door before or after operating the call button accordingly, the maintenance mechanic then easily has access to or at least sight of the underside of the selected car from the landing floor.

Alternatively, the landing call receiving means may comprise an "up" call button indicating that the calling persons wants to travel upwards and a "down" call button to call the elevator to travel downwards. Now, operating the "up" call button in a predetermined sequence like for example three short presses followed by three long presses can be identified as the first predetermined identification pattern indicating a stop position allowing access to the roof. Operating the "down" call button in the same predetermined sequence of three short and three long presses can be identified as the second predetermined identification pattern indicating a stop position allowing access to or sight of the underside of the car.

According to a preferred embodiment the control moves the car to the predetermined stop position when the car is empty and/or there are no pending car calls. Thus, switched into the maintenance mode by opening or unlocking a landing door and operating a landing call receiving means in a predetermined identification pattern, the elevator control first may determine whether the car is empty (e.g. by analyzing a weighing signal from the car or after all calls of the car have been satisfied). Additionally or alternatively, the elevator control may determine whether there are pending calls for that car. This may be answered in the affirmative either if there are no pending calls at all or if the calls pending can be answered by other cars of the elevator. Then, only if the car is empty and/or there are no pending calls to be answered by that car, the elevator control moves the car to the predetermined stop position, allowing access to or at least sight of its roof or underside.

After having finished maintenance, the mechanic leaves the elevator shaft and closes the landing door. By closing the door, elevator control is switched back into normal mode (i.e. answering passenger calls).

Advantageously, elevator control only is switched back into normal mode after the landing door has been closed and the landing call receiving means has been operated in a predetermined closing identification pattern which may be identical to or different from the predetermined identification pattern to switch into maintenance code. Thus, it can be secured that the mechanic has intentionally closed the landing door after having left the elevator shaft. Thereby, unintentional switch-back into normal operation while the mechanic still is located within the elevator shaft can be prevented.

If the predetermined closing identification pattern is identical to the predetermined identification pattern to switch into maintenance code, the mechanic only must remember one pattern which facilitates daily operation. On the other hand, if the second predetermined identification pattern differs from the predetermined identification pattern to switch into maintenance code, this further decreases the possibility of an unauthorized person getting access to the car roof (which requires knowledge of the predetermined identification pattern to switch into maintenance code) and remaining there after having closed the landing door (since it requires knowledge of the predetermined closing identification pattern to switch back into normal mode).

Further purposes, characteristics, and advantages of the present invention follow from the claims and exemplary embodiments.

DETAILED DESCRIPTION OF THE INVENTION

Figure 1:
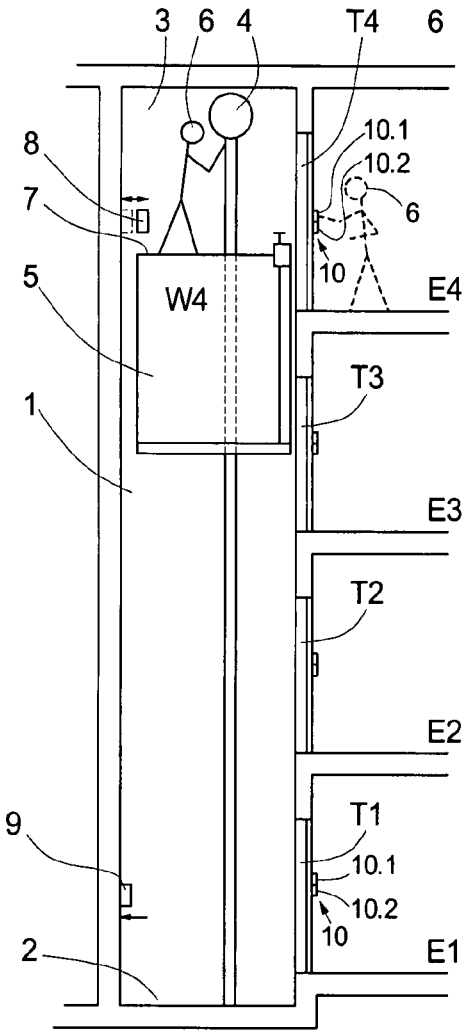
FIG. 1 shows schematically an elevator which can be controlled by a method according to one embodiment of the present invention.

As shown in FIG. 1, an elevator which can be controlled by a method according to one embodiment of the present invention comprises an elevator shaft 1 in which at least one car 5 is ascending and descending between different levels E1 to E4. Thereto, in each level E1 to E4 there is provided a call button 10 as a landing call receiving means. Pressing of a call button 10 is registered by an elevator control and a car 5 is sent to the corresponding floor in order to answer the call.

Not shown in FIG. 1, there is provided a plurality of cars in parallel elevator shafts. Now, if a call button is pressed by a passenger, the elevator control determines on the basis of a stored algorithm, which of the plurality of cars is to answer that call. For example, the car next to the floor assigned to said call button 10 may be determined. Alternatively, an unoccupied car may be sent to answer this call.

The respective call button 10 advantageously comprises two separate buttons, one "up" button 10.1 and one "down" button 10.2. As it is known in the art, pressing the "up" button will be registered as calling a car to go up and vice versa. Then, the elevator control will determine a car going up already only to answer "up" button calls while "down" button calls only will be answered by cars already descending.

In order to get access to the roof 7 of the elevator car 5 being one of a group of cars, a maintenance mechanic 6, positioned at one of the landing floor levels (level E4 is depicted in the FIG. 1 as an example), first opens or unlocks the corresponding landing door T4 by a triangular key, activating its emergency unlocking system. This switches the elevator control of the elevator car 5, which has been selected by opening a landing door of the corresponding elevator shaft, into a blocked status, in which travel of the selected car 5 is prevented.

Subsequently, mechanic 6 presses the "up" button 10.1 and/or the "down" button 10.2 on this landing floor, in a predetermined sequence. Said sequence is chosen such that it is unlikely to be applied by normal passengers by chance. Since a passenger may repeatedly press a call button if being impatient, or different passengers may press the same button, said sequence may comprise long and short presses of the "up" button 10.1 and/or the "down" button 10.2 in a predetermined sequence and within a predetermined time period. For example, such sequence may comprise two short presses, followed by one long press, all within three seconds. Thus, by pressing the "up" button 10.1 in said sequence, the mechanic 6 operates the landing call receiving means in a first predetermined identification pattern.

The recognition of said first predetermined identification pattern switches the control of the selected elevator car 5 from blocked status into maintenance mode. In this maintenance mode, the elevator control determines the floor level E4 at which the maintenance mechanic 6 inputted the call and causes the selected car 5 to travel to a predetermined stop position W4, associated with said determined floor level. Since the mechanic operated the landing call receiving means in the first predetermined identification pattern by pressing the "up" button 10.1, the control moves the car to a stop position W4, shown in FIG. 1, in which the roof 7 of the car 5 is easily accessible from the determined floor E4 through the corresponding landing door T4.

Alternatively, the elevator control may move the car to the stop position W4 in which its roof 7 of the car 5 is accessible, irrespective of whether the "up" button 10.1 or the "down" button 10.2 has been pressed. This is the preferred solution for elevator installations requiring maintenance access only to the car roof in all the maintenance levels beyond the lowest level.

If, as it is shown in FIG. 1, the determined level is the upmost level, also machinery located in the upper part 3 of the elevator shaft 1, in particular the drive unit 4 and/or ropes may be inspected and/or maintained.

Figure 2:
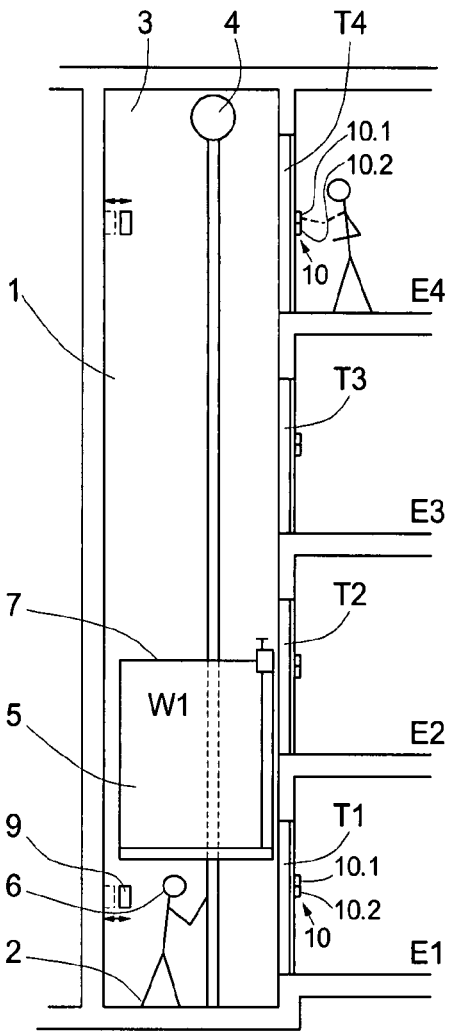
FIG. 2 shows the elevator of FIG. 1 in a state allowing access to the car underside.

Turning to FIG. 2, if mechanic 6 wants to maintain components arranged in the region of the underside of car 5 and/or in the lower part 2 of the elevator shaft 1, he may open or unlock landing door T1 of the lowest floor, thereby switching the control of the elevator car 5 into its blocked status. By pressing the "down" button 10.2 at this floor in the predetermined sequence comprising two short presses, followed by one long press, all within three seconds, the mechanic 6 operates the landing call receiving means in a second predetermined identification pattern, thereby switching the control of elevator car 5 from blocked status into maintenance mode.

In this maintenance mode, the elevator control determines the floor level E1 at which the maintenance mechanic 6 inputted the call and causes the selected car 5 to travel to a predetermined stop position W1 associated with the determined floor level E1. Since the mechanic operated the landing call receiving means in the second predetermined identification pattern by pressing the "down" button 10.2 in the predetermined sequence, the control moves the car to a stop position W1, shown in FIG. 2, in which the maintenance mechanic 6 has access to or at least sight on the underside of the car 5 from the determined floor E1 through the corresponding landing door T1.

Alternatively again, the elevator control may move the car to the stop position W1 such that its underside is accessible, irrespective of whether the "up" button or the "down" button has been pressed in the predetermined sequence. This is the preferred solution for elevator installations requiring maintenance access to the underside of the elevator car only from the lowest floor level. In this situation, the stop position W1 is such that the underside of the elevator car is positioned at a certain distance above the lowest floor level E1, allowing the maintenance mechanic to enter from the lowest floor through the open shaft door T1 into the elevator shaft pit 2. Standing on the bottom of the shaft pit 2, the maintenance mechanic is able to inspect and maintain said components arranged in the region of the elevator car 5 as well as a number of components placed in the lowest part of the elevator shaft 1.

Alternatively, the first and second predetermined identification pattern may not be defined as pressing the "up" button and the "down" button respectively in the same sequence of presses, but may be distinguished by pressing one call button in different sequences. For example, instead of pressing the "up" button by two short presses, followed by one long press, all within three seconds, the first predetermined identification pattern may be determined by pressing one call button five times within three seconds. Then the second predetermined identification pattern may be determined by pressing the same call button three times within three seconds.

Advantageously the elevator control provides an information signal indicating to the maintenance mechanic that the elevator control is switched into maintenance mode, in which the elevator control controls the car to travel to a predetermined stop position. If available, hall lanterns provided on the landing levels, in normal elevator operation pre-announcing and indicating travel of the elevator car, are used for indicating the maintenance mode status.

For instance, blinking hall lanterns inform the maintenance mechanic that the control has switched to said maintenance mode and that the car is on its way to the requested maintenance position. When the car has reached the requested maintenance position, the hall lanterns are switched from blinking to continuous illumination as long as the car is resting in said maintenance position and in maintenance mode. Of course, the described information may also be provided by other types of indicators, for instance by a buzzer or any indicating lamp available on the landing levels.

As it is known in the art, for example from EP 1 466 853 A1, whose content is incorporated herein by reference, safety means 8, 9 may be operated by the elevator control in maintenance mode. I.e. when the elevator control is switched into maintenance mode by receiving the first predetermined identification signal or receiving a predetermined identification signal from a landing call receiving means not corresponding to the lowest level, indicating a request for access to the car roof 7, a safety means 8 may be activated, preventing the elevator car 5 from traveling above a highest stop position W4 shown in FIG. 1. Thereby, a dangerous reduction of the room 3 above the roof of the elevator car is prevented. In the same way, when the elevator control is switched into maintenance mode by receiving the second predetermined identification signal or receiving a predetermined identification signal from a landing call receiving means corresponding to the lowest level, indicating a request for access to the car underside, a safety means 9 may be activated preventing the elevator car 5 from traveling below a lowest stop position W1 shown in FIG. 2, thereby preventing a dangerous reduction of the room 2 below the underside of the car.

Although the present invention has been described in relation to particular embodiments thereof, many other variations and modifications and other uses will become apparent to those skilled in the art. It is preferred, therefore, that the present invention be limited but by the specific disclosure herein, but only by the appended claims.

The invention claimed is:

1. A method of controlling access to an elevator car, comprising the steps of:

unlocking or opening a landing door of an elevator shaft in which the car is running; and switching an elevator control into a maintenance mode, the switching causing the car to travel to a predetermined stop position of a selected floor, which predetermined stop position is a position wherein a floor of the elevator car and a floor of the landing are not coplanar, the predetermined stop position permitting access to at least one of a roof and an underside of the elevator car from the selected floor, the elevator control being switched into said maintenance mode by:

first, unlocking or opening the landing door; and second, operating a landing call receiving means in a predetermined identification pattern which differs from a call pattern for calling the elevator in normal elevator operation, the landing call receiving means and the landing door located at the selected floor, the predetermined stop position based on the selected floor.

2. The method according to claim 1, including manually opening the landing door by actuating an emergency unlocking system.

3. The method according to claim 2, including actuating the emergency unlocking system with a key.

4. The method according to claim 1, wherein the landing call receiving means comprises a call button, and/or a card reader and/or a voice call receiver.

5. The method according to claim 4, wherein the landing call receiving means comprises at least two call buttons including an "up" button and a "down" button, the predetermined identification pattern comprising the selection of one of the at least two call buttons.

6. The method according to claim 1, wherein the control is switched back from maintenance mode into a normal mode by closing the landing door and operating the landing call receiving means in a predetermined closing identification pattern.

7. The method according to claim 6, wherein the predetermined closing identification pattern is identical to the predetermined identification pattern to switch into maintenance mode.

8. The method according to claim 6, wherein the predetermined closing identification pattern is different from the predetermined identification pattern to switch into maintenance mode.

9. The method according to claim 1, wherein the landing door is opened or unlocked within a predetermined time period before operating the landing call receiving means in order to switch into said maintenance mode.

10. The method according to claim 1, wherein a first predetermined identification pattern and/or a predetermined identification pattern received from a landing call receiving means of a floor beyond a lowest floor indicates a stop position allowing access to the roof from the selected floor; and a second predetermined identification pattern, different from the first predetermined identification pattern, and/or a predetermined identification pattern received from a landing call receiving means of the lowest floor indicates a stop position allowing access to the underside of the elevator car, from the selected floor.

11. The method according to claim 1, wherein the elevator control moves the elevator car to the predetermined stop position when the car is empty and/or there are no pending car calls.

* * * * *